US007789622B2

(12) United States Patent
Acre

(10) Patent No.: US 7,789,622 B2
(45) Date of Patent: Sep. 7, 2010

(54) ENGINE COOLING FAN ASSEMBLY

(75) Inventor: James A Acre, Barker, NY (US)

(73) Assignee: Delphi Technologies, Inc., Troy, MI (US)

( * ) Notice: Subject to any disclaimer, the term of this patent is extended or adjusted under 35 U.S.C. 154(b) by 894 days.

(21) Appl. No.: 11/527,186

(22) Filed: Sep. 26, 2006

(65) Prior Publication Data

US 2008/0075585 A1 Mar. 27, 2008

(51) Int. Cl.
*F04D 29/32* (2006.01)
*F04D 29/54* (2006.01)
*F01D 9/00* (2006.01)

(52) U.S. Cl. ..... 415/209.3; 415/220; 416/189

(58) Field of Classification Search ..... 415/222, 415/211.2, 220, 209.3; 416/169 A, 189
See application file for complete search history.

(56) References Cited

U.S. PATENT DOCUMENTS 4,566,852 A * 1/1986 Hauser ..... 415/220
5,244,347 A * 9/1993 Gallivan et al. ..... 416/189
5,443,363 A * 8/1995 Cho ..... 415/211.1
5,489,186 A * 2/1996 Yapp et al. ..... 415/58.7
6,595,744 B2 * 7/2003 Van Houten ..... 415/173.1
6,600,249 B2 * 7/2003 Nelson et al. ..... 310/91

* cited by examiner

*Primary Examiner*—Edward Look
*Assistant Examiner*—Jesse Prager
(74) *Attorney, Agent, or Firm*—Patrick M. Griffin

(57) ABSTRACT

A cooling fan assembly for cooling a heat exchanger includes a shroud having a plurality of stators extending radially to support a hub. A flow-guide including an outer rim and inner rim surrounds the shroud and extends to the heat exchanger. The outer rim extends from the heat exchanger to the stators. The inner rim extends annularly about the axis and curves convexly from the outer rim. A fan unit includes a plurality of fan blades extending radially from a motor supported by the hub. Each fan blade includes a leading edge facing the stators and a trailing edge facing in the opposite direction with a blade tip extending therebetween. A fan section extends from the inner rim and axially about the fan blades. The stators are disposed between the heat exchanger and the fan blades. The stators have a front edge facing the heat exchanger and a back edge facing the fan blades. Each stator is connected to the inner rim with the front edge extending radially outward and farther than the back edge.

13 Claims, 5 Drawing Sheets

ENGINE COOLING FAN ASSEMBLY

BACKGROUND OF THE INVENTION

1. Field of the Invention

The subject invention relates to a cooling fan assembly for cooling a heat exchanger of an automotive engine.

2. Description of the Prior Art

Automotive engines are typically cooled using a heat exchanger for transferring heat from a liquid to cool the engine. Generally, one or more cooling fan units are used for moving air across to the heat exchanger to enhance heat transfer from the liquid to the surrounding air.

Traditional cooling fan units include a shroud having a cylindrical wall extending about an axis to define a circular opening for delivering air from the cooling fan unit. A plurality of stators typically extends radially from the rear of the shroud and into the circular opening toward the axis for supporting a hub. A motor is generally supported on the hub and includes a shaft extending axially toward the front of the cooling fan unit. Fan blades extend radially from the shaft and are disposed between the heat exchanger and the stators for moving air from the heat exchanger to the opening and out the rear of the shroud. Typically, a flow guide surrounds the shroud and extends to the heat exchanger for guiding air from the heat exchanger to the fan blades.

As stated above, the shaft extends toward the front of the fan unit and the stators are disposed upstream from the fan blades. Consequently, the fan blades are disposed closer to the heat exchanger allowing air to escape the shroud. Furthermore, the motor may be exposed to heated components that reduce the life of the motor. Accordingly, the overall package of the cooling fan assembly is limited by the location of the fan motor.

Therefore, it is desirable to reduce the overall package of the airflow cooling assembly while protecting the fan motor from heat and reducing airflow losses from the shroud.

SUMMARY OF THE INVENTION AND ADVANTAGES

The invention provides for a cooling fan assembly for cooling a heat exchanger of an automotive engine including a heat exchanger for transferring heat from a liquid to cool the engine. The cooling fan assembly includes a shroud having a cylindrical wall extending about an axis to define a circular opening having an opening radius and extending axially to an exit throat. A plurality of stators extends radially from the shroud and into the circular opening toward the axis to support a hub. A flow-guide surrounds the shroud and extends to the heat exchanger for guiding airflow from the heat exchanger to the circular opening. The flow-guide is generally funnel-shaped and has an outer rim extending annularly about the axis and curving concavely inwardly in the axial direction from the heat exchanger to the stators. The flow-guide further includes an inner rim extending annularly about the axis and curves convexly in the axial direction from the outer rim. A fan unit moves air through the heat exchanger toward the circular opening. The fan unit includes a motor supported by the hub and a plurality of fan blades extending radially from the motor. Each of the fan blades include a leading edge facing the stators and a trailing edge facing in the opposite direction. A blade tip extends between the leading edge and the trailing edge. A fan section extends from the inner rim and axially about the fan blades of the fan unit. The stators are disposed axially between the heat exchanger and the fan blades of the fan unit. Each of the stators has a front edge facing the heat exchanger and a back edge facing the fan blades of the fan unit. The invention is distinguished by each of the stators being connected to the inner rim with the front edge extending radially outward and farther than the back edge.

By providing stators with the front edge extending radially outward and farther than the back edge, the fan blades can be disposed further from the heat exchanger for allowing additional airflow passage volume into the fan blades and reducing airflow loss from the shroud. Furthermore, the blade tips can extend axially along an increasing radius for improving radial airflow generated by the fan blades. In addition, the hub is disposed between the heat exchanger and the motor for shielding heat from the motor. Accordingly, the motor can be disposed closer to the heat exchanger and the overall package of the cooling fan assembly can be decreased.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
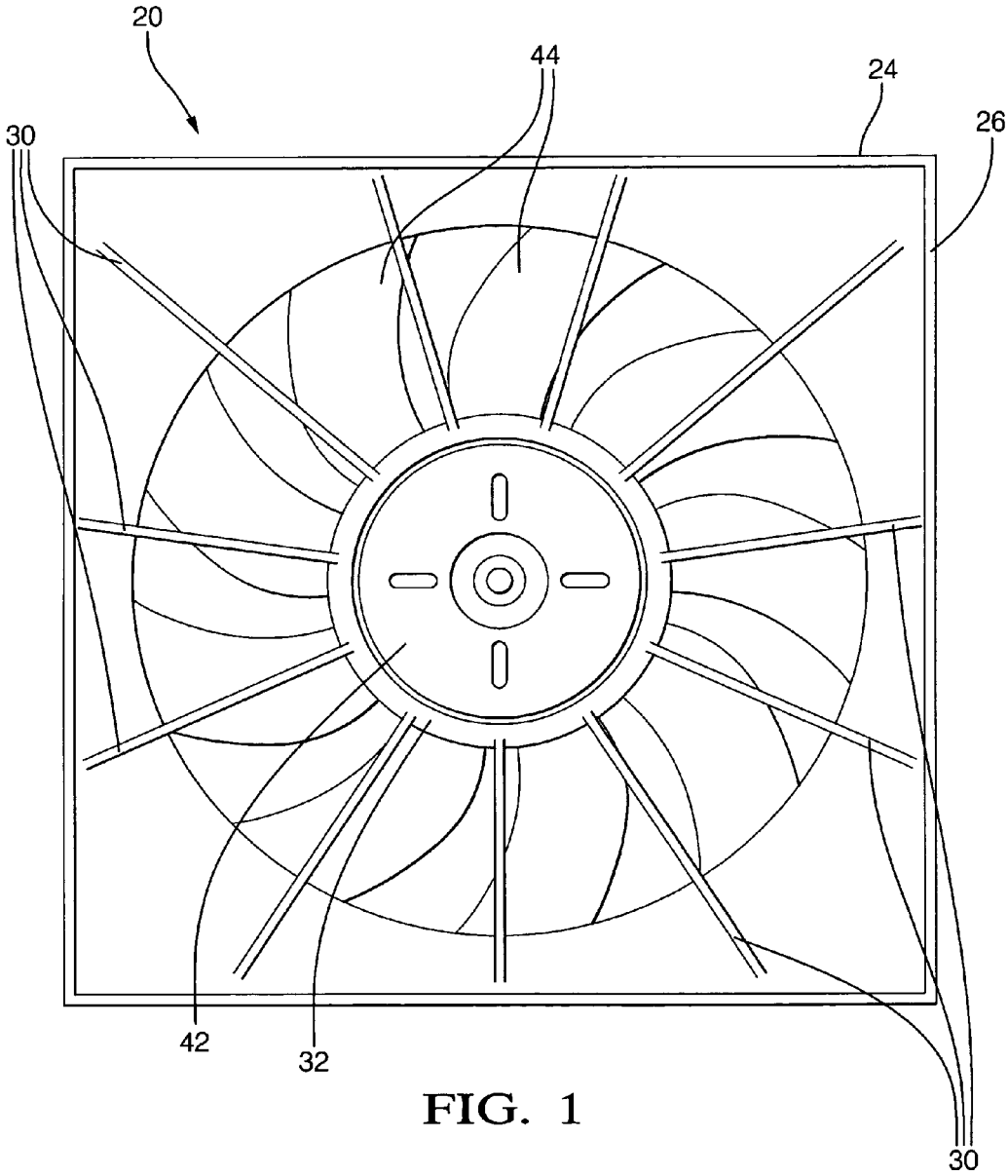
FIG. 1 is a front view of an engine cooling fan assembly according to the present invention.
Figure 2:
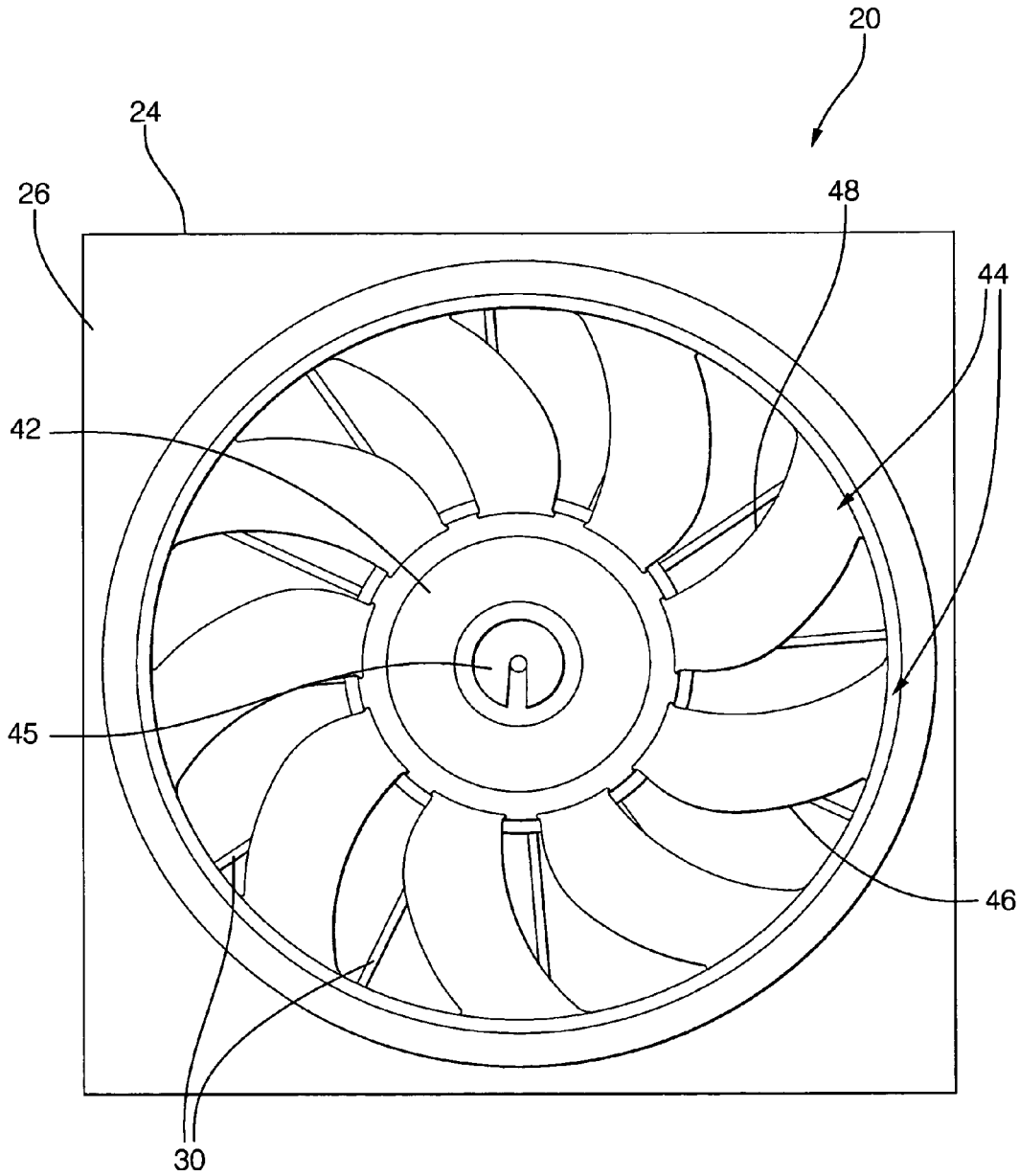
FIG. 2 is a rear view of an engine cooling fan assembly according to the present invention.

Referring to the Figures, wherein like numerals indicate corresponding parts throughout the several views, a cooling fan assembly 20 generally shown for cooling a heat exchanger 22 of an automotive engine.

The heat exchanger 22 has a rectangular periphery for transferring heat from a liquid to cool the engine. A shroud 24 generally indicated includes a cylindrical wall 26 extending about an axis A to define a circular opening having an opening radius $r_o$ and extending axially to an exit throat 28. A plurality of stators 30 having a stator radius $r_s$ extends radially from the shroud 24 and into the circular opening toward the axis A to support a hub 32 on the axis A. A flow-guide 34 generally indicated surrounds the shroud 24 and extends to the rectangular periphery for guiding airflow from the heat exchanger 22 to the circular opening. The flow-guide 34 is generally funnel-shaped and includes an outer rim 36 and an inner rim 38. The outer rim 36 extends annularly about the axis A and curves concavely inward in the axial direction from the heat exchanger 22 to the stators 30. The inner rim 38 extends annularly about the axis A and curves convexly in the axial direction from the outer rim 36. The shroud 24 may include a plurality of ribs 43 to support the shroud 24 and the inner rim 38. The ribs 43 have a vertical section extending radially from the inner rim 38 and a curved section extending convexly in the radial direction from the vertical section to the shroud 24.

A fan unit 40 generally indicated can move air through the heat exchanger 22 toward the circular opening. The fan unit 40 includes a motor 42 supported by the hub 32 and a plurality of fan blades 44 generally indicated extending radially from the motor 42. The motor 42 includes a shaft 45 extending axially in the opposite direction of the stators 30 toward the rear of the cooling fan assembly 20. Each of the fan blades 44 includes a leading edge 46 facing the stators 30 and a trailing edge 48 facing in the opposite direction. A blade tip 50 extends axially between the leading edge 46 and the trailing edge 48.

A fan section 52 extends from the inner rim 38 and axially about the fan blades 44 of the fan unit 40. The stators 30 are disposed axially upstream from the fan blades 44 of the fan unit 40 with each of the stators 30 having a front edge 54 facing the heat exchanger 22 and a back edge 56 facing the fan blades 44 of the fan unit 40. By disposing the stators 30 between the heat exchanger 22 and the fan blades 44, the hub 32 can shield the motor 42 from heat generated by the heat exchanger 22.

The engine cooling fan assembly 20 is distinguished by each of the stators 30 being connected to the inner rim 38 with the front edge 54 extending radially outwardly and farther than the back edge 56. The leading edge 46 of each fan blade 44 extends radially to the blade tip 50 a shorter distance than the trailing edge 48 extends radially to the blade tip 50.

Each blade tip 50 extends axially along an increasing stator radius $r_s$ between the leading edge 46 and the trailing edge 48. The blade tip 50 at the leading edge 46 of each fan blade 44 is disposed axially from the exit throat 28 in the direction away from the stators 30. Furthermore, the blade tip 50 can curve concavely toward the trailing edge 48 as shown in FIGS. 3-7, or can extend parallel with the axis A between the leading edge 46 and the trailing edge 48 as shown in FIG. 8. The fan blades 44 can include a blade band 58 to extend the blade tips 50 in the axial direction. Specifically, the blade band 58 includes an upper end extending axially beyond the trailing edge 48 and a lower end extending axially beyond the leading edge 46. The blade band 58 is coupled to each of the blade tips 50 and extends circumferentially about each fan blade 44.

Figure 6:
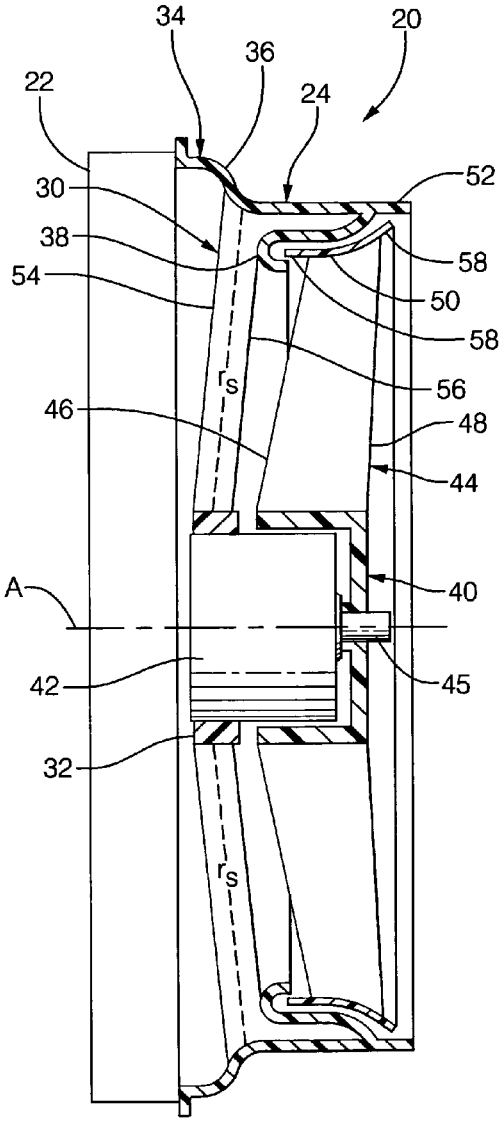
FIG. 6 is a cross-sectional view of the engine cooling fan assembly shown in FIG. 3 having an alternative shroud design.

With exception of the embodiment shown in FIG. 6, the leading edge 46 of the fan blades 44 slants axially away from the stators 30 and extends to at least the lower end of the inner rim 38 to define the exit throat 28. The exit throat 28 has a throat diameter and extends radially to the shroud 24. When the fan rotates, air directed by the fan blades 44 may be recirculated through the exit throat 28 to the fan blades 44 where it is again moved radially from the rear of the fan unit 40.

Figure 3:
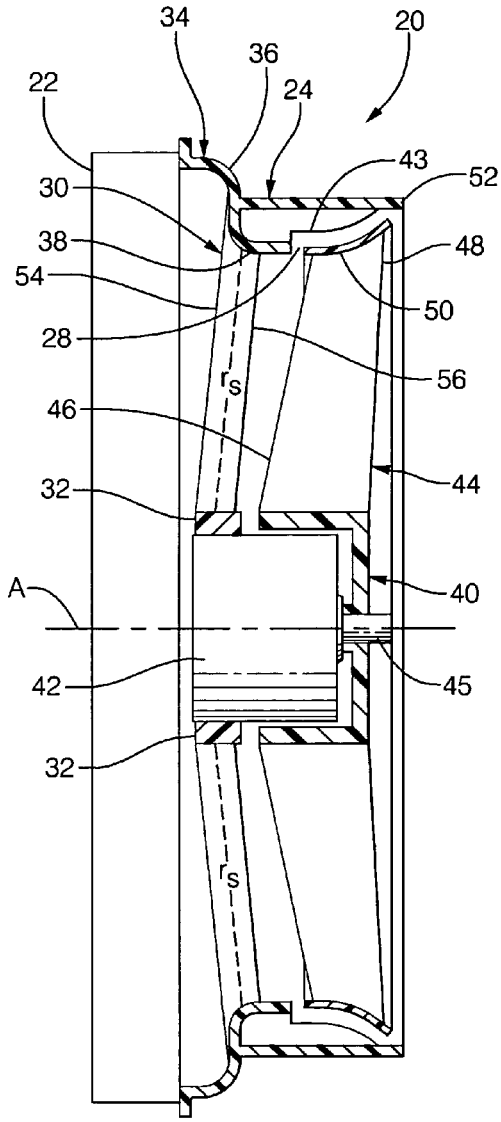
FIG. 3 is a cross-sectional view of an engine cooling fan assembly according to the present invention.
Figure 4:
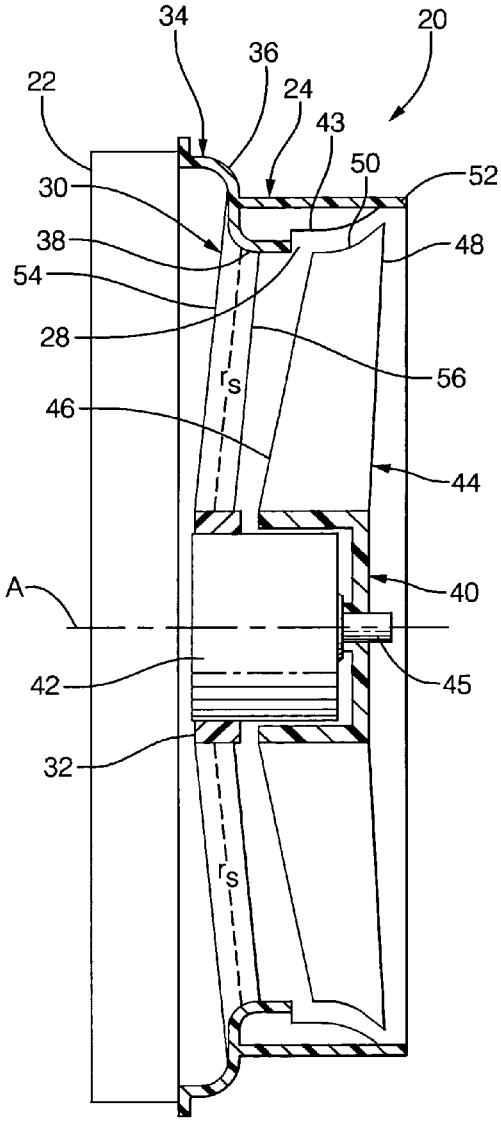
FIG. 4 is a cross-sectional view of the engine cooling fan assembly shown in FIG. 3 having an unbanded fan blade.

In another embodiment of the invention, the fan section 52 extends axially beyond the trailing edge 48 of the fan blades 44 as shown in FIGS. 3, 4, 6, 7, and 8. As air moves from the heat exchanger 22 to the fan blades 44, air flows around the inner rim 38 and is directed from the rear of the fan unit 40 by the fan blades 44. By extending the fan section 52 beyond the trailing edge 48, air diffusion in the radial direction can be increased. The fan blade 44 may have a blade band 58 as shown in FIG. 3, or the fan blade 44 may be unbanded as shown in FIG. 4.

Figure 5:
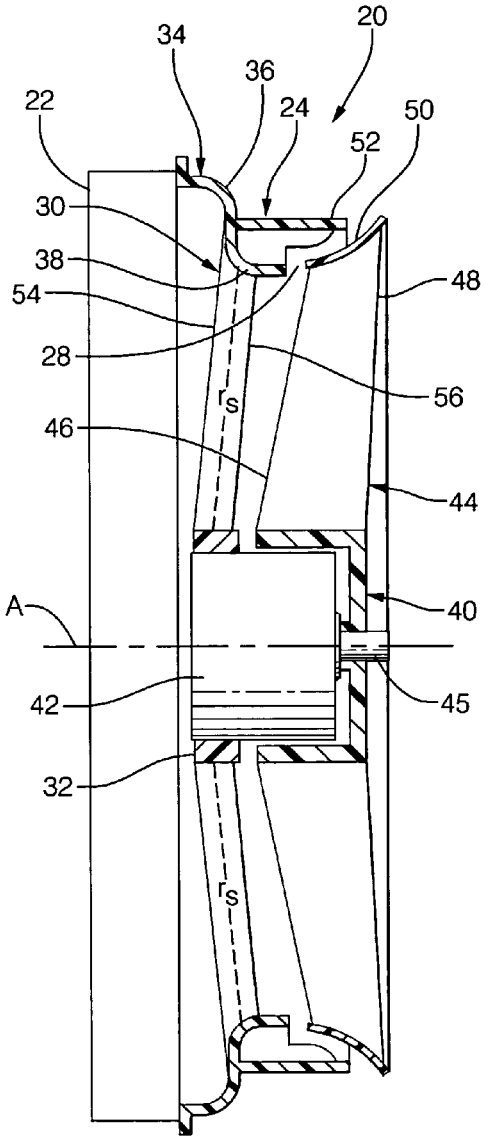
FIG. 5 is a cross-sectional view of the engine cooing fan assembly shown in FIG. 3 having the fan blades extending radially beyond the shroud.

Referring to FIG. 5, the leading edge 46 of the fan blades 44 extends beyond the lower end of the inner rim 38 to define the exit throat 28 having a throat diameter that increases as the exit throat 28 extends radially toward the shroud 24. Additionally, the trailing edge 48 of the fan blade 44 extends radially beyond the fan section 52.

Referring to FIG. 6, the inner rim 38 can extend from the stator 30 and curve concavely in the axial direction toward the stators 30 to the shroud 24 to define a rim lip extending into the exit throat 28. Additionally, the lower end of each fan blade 44 extends above the fan lip and into the exit throat 28 for increasing the amount of airflow recirculated to the fan blades 44.

Figure 7:
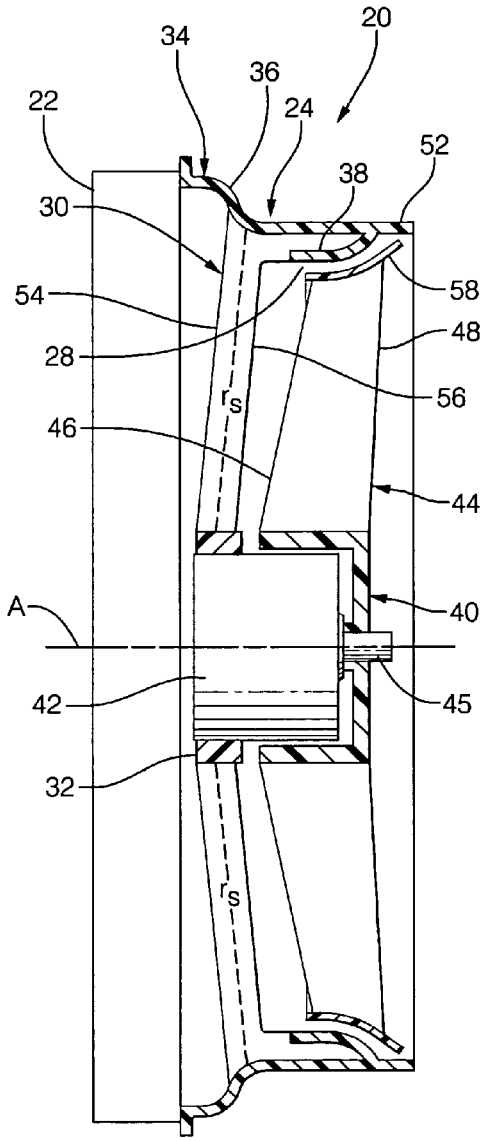
FIG. 7 a cross-sectional view of the engine cooling fan assembly shown in FIG. 3 having another alternative shroud design.
Figure 8:
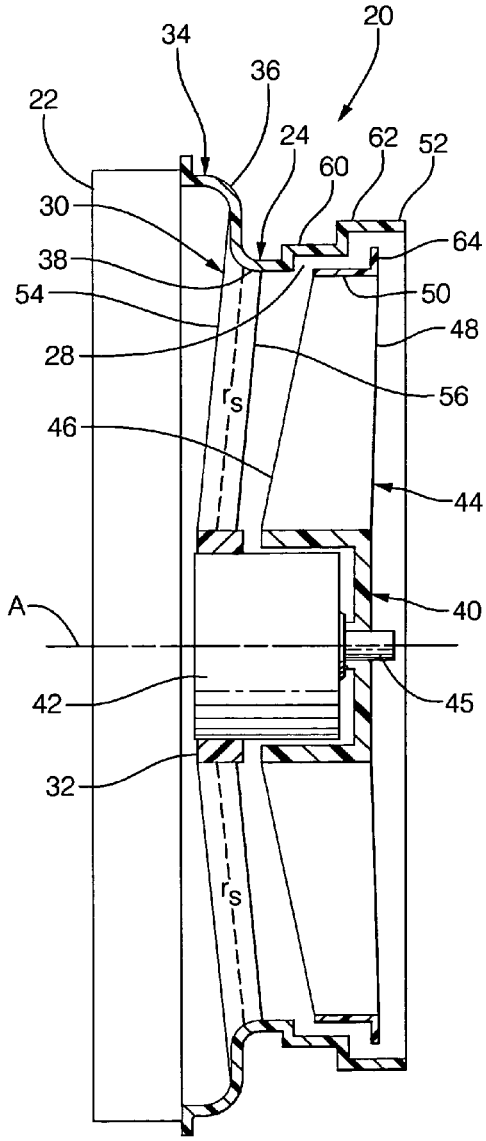
FIG. 8 is a cross-sectional view of the engine cooling fan assembly shown in FIG. 3 having a stair-like shroud design.

Referring to FIG. 7, the inner rim 38 extends convexly in the radial direction from the outer rim 36 to the shroud 24 and the leading edge 46 extends below the inner rim 38. Accordingly, the exit throat 28 has a throat diameter extending axially to the blade tip 50 as opposed to extending radially to the shroud 24. By defining an exit throat 28 that extends in the axial direction, airflow recirculation may be improved.

In yet another embodiment of the invention, the shroud 24 is stair-shaped as shown in FIG. 8. The shroud 24 includes a middle section 60 extending radially and axially from the inner rim 38 and a posterior section 62 extending radially from the middle section 60 with the fan section 52 extending axially beyond the trailing edge 48. By utilizing the stair-like shroud 24 design, fan blades 44 with tips extending parallel to the axis A can be used, which may simplify the fan blade 44 manufacturing process. The trailing edge 48 includes a seal portion 64 extending radially beyond the blade tip 50.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments failing within the scope of the appended claims.

What is claimed is:

1. A cooling fan assembly for cooling a heat exchanger of an automotive engine comprising;

a heat exchanger for transferring heat from a liquid to cool the engine, a shroud having a cylindrical wall extending about an axis to define a circular opening having an opening radius and extending axially to an exit throat, a plurality of stators extending radially from said shroud and into said circular opening toward said axis, a hub supported by said stators on said axis, a flow-guide surrounding said shroud and extending to said heat exchanger for guiding airflow from said heat exchanger to said circular opening, said flow-guide being generally funnel-shaped having an outer rim extending annularly about said axis and curving concavely inwardly in the axial direction from said heat exchanger to said stators, said flow-guide including an inner rim extending annularly about said axis and curving convexly in the axial direction from said outer rim, a fan unit for moving air across said heat exchanger toward said circular opening and including a motor supported by said hub and a plurality of fan blades extending radially from said motor, each of said fan blades including a leading edge facing said stators and a trailing edge facing in the opposite direction and a blade tip extending axially therebetween, said shroud including a fan section extending from said inner rim and axially about said fan blades of said fan unit, said stators being disposed axially between said heat exchanger and said fan blades of said fan unit, each of said stators having a front edge facing said heat exchanger and a back edge facing said fan blades of said fan unit, and each of said stators being connected to said inner rim with said front edge extending radially outwardly farther than said back edge.

2. An engine cooling fan assembly as set forth in claim 1 wherein said leading edge of each fan blade extends radially to said tip a shorter distance than said trailing edge extends radially to said tip with each blade tip having a continuously increasing radius from said leading edge to said trailing edge.

3. An engine cooling fan assembly as set forth in claim 2 wherein said tip at said leading edge of each of said fan blades is disposed axially from said exit throat in the direction away from said stators.

4. An engine cooling fan assembly as set forth in claim 3 wherein said leading edge of said fan blades slants axially away from said stators.

5. An engine cooling fan assembly as set forth in claim 3 wherein said leading edge extends to at least the lower end of said inner rim to define said exit throat having a throat diameter and extending radially to said shroud.

6. An engine fan assembly as set forth in claim 5 wherein said fan section extends axially beyond said trailing edge of said fan blades.

7. An engine fan assembly as set forth in claim 5 wherein said leading edge of said fan blades extends beyond the lower end of said inner rim to define said exit throat having a throat diameter that increases as said exit throat extends radially toward said shroud.

8. An engine cooling fan assembly as set forth in claim 7 wherein said trailing edge of said fan blades extends radially beyond said fan section.

9. An engine cooling fan assembly as set forth in claim 3 wherein said blade tip curves concavely toward said trailing edge.

10. An engine cooling fan assembly as set forth in claim 3 wherein said fan blades include a blade band coupled to each of said blade tips and extending circumferentially about said plurality of fan blades with said blade band including an upper end extending axially beyond said trailing edge and a lower end extending axially beyond said leading edge.

11. An engine cooling fan assembly as set forth in claim 10 wherein said lower end of said fan blades extends radially beyond said inner rim into said exit throat.

12. An engine cooling fan assembly as set forth in claim 1 wherein said shroud includes a plurality of ribs having a vertical section extending radially from said inner rim and a curved section extending convexly in the radial direction from said vertical section to said shroud.

13. An engine cooling fan assembly as set forth in claim 1 wherein said motor includes a shaft extending axially in the opposite direction from said stators.

* * * * *